US005793876A

United States Patent [19]

Derogis et al.

[11] Patent Number: 5,793,876

[45] Date of Patent: Aug. 11, 1998

[54] METHOD FOR THE DIFFUSION OF A SOUND WITH A GIVEN DENSITY

[75] Inventors: Philippe Derogis, Fondettes; René Causse; Olivier Warusfel, both of Paris, all of France

[73] Assignee: France Telecom, Paris, France

[21] Appl. No.: 671,769

[22] Filed: Jun. 28, 1996

[30] Foreign Application Priority Data

Jul. 3, 1995 [FR] France ..... 95 08007

[51] Int. Cl.[6] ..... H04R 1/02

[52] U.S. Cl. ..... 381/89; 381/90; 381/97

[58] Field of Search ..... 381/90, 89, 97, 381/182, 188, 205, 111

[56] References Cited

U.S. PATENT DOCUMENTS

| | | | |
|---|---|---|---|
| 4,673,057 | 6/1987 | Glassco . | |
| 4,845,759 | 7/1989 | Taylor . | |
| 5,233,664 | 8/1993 | Yanagawa et al. | 381/89 |

FOREIGN PATENT DOCUMENTS

| | | |
|---|---|---|
| 0 649 269 | 4/1995 | European Pat. Off. . |
| 42 05 037 | 2/1993 | Germany . |
| WO 96/14723 | 5/1996 | Netherlands . |
| 1378784 | 12/1974 | United Kingdom . |
| 1456790 | 11/1976 | United Kingdom . |
| 2259426 | 3/1993 | United Kingdom . |
| 2273848 | 6/1994 | United Kingdom . |

OTHER PUBLICATIONS

Japan Abstract No. 03986097 & JP 04–0351197; Matsushita, Dec. 1992.

Japan Abstract NO. 03264298 & JP 02–023798; Toa, Sep. 1990.

*Primary Examiner*—Curtis Kuntz
*Assistant Examiner*—Vivian Chang
*Attorney, Agent, or Firm*—Nilles & Nilles SC

[57] ABSTRACT

To obtain a directivity pattern representing the directivity of an original or virtual sound source, directivity patterns of different sources are composed algebraically. To take account of the progress of the directivity patterns of sources that differ with the frequency, the signals applied to these sources are filtered so that the composite directivity function represents the expected directivity pattern throughout the spectrum. The coefficients of the filters are determined by a method of optimization in modulus and in phase.

26 Claims, 2 Drawing Sheets

METHOD FOR THE DIFFUSION OF A SOUND WITH A GIVEN DENSITY

BACKGROUND OF THE INVENTION

1. Field of the Invention

The present invention relates generally to a method for diffusion of a sound with a given directivity. The method can be applied in the field of acoustics to the reproduction, with artificial sound sources, of sounds originally produced by natural sources or of sounds that have to be produced synthetically and with a given directivity. It can be used for acoustic installations in entertainment halls and places of sound diffusion, and also in the industrial field or in the field of sound diffusion in general.

2. Description of the Prior Art

A sound source can generally be characterized by three physical properties: its timbre (temporal and spectral responses, its intensity and its directivity. Loudspeakers or piezoelectrical type transducers enable an almost perfect restitution of the timbre and intensity of sound. However, these devices have their own directivity. consequently, they are incapable of reproducing the directivity of a sound source whose sounds they diffuse.

Although the directivity of a trumpet can approximately be compared to the directivity of a loudspeaker, however instruments with side holes (woodwind class) or having a sound board (string class, piano) are having very complex directivity patterns which cannot be restituted very faithfully by a single loudspeaker.

There also is a known way of building sound emission chambers provided with sets of loudspeakers excited by one and the same electrical signal. Depending on the frequency range, whether it is high, medium or low, the passband of these loudspeakers enables them to diffuse spectral components of the total sound. Since each of these loudspeakers has its own directivity, it can be seen that it is not possible to achieve the directivity of a sound to be reproduced. Thus, in the prior art, the problem has been completely disregarded, since there is no solution to it.

There is also a known way, in a field known as acoustic control, of modifying acoustic stresses at a particular place. For example, this particular place may be a workstation of an operator who, because of his location, is subjected to troublesome noise from identified sources or, by reverberation, to such noise from many non-identifiable sources. The principle of acoustic control consists in having a number of is acoustic compensation sources available in the vicinity of this workstation, measuring the ambient noise in the vicinity of the operator by means of microphones and, with these acoustic compensation sources, producing antagonistic sounds (sounds in phase opposition) so that the workstation is less noisy. The nature of this type of phenomenon, the presence of a negative feedback in the system, contains no teaching on directivity.

The invention is aimed at achieving the ability, with an artificial sound source, to simulate the directivity of a natural or virtual sound source. The principle of the invention consists of the use of several artificial sound sources, assembled in an area, such that the values of directivity of these sources are different from one another, and in then composing a composite directivity pattern with the values of directivity of each of these sources so as to approach, as closely as possible, an expected directivity pattern. The different artificial sources used are machines receiving an electrical signal and converting it into sound waves or pressure waves. They may be sources whose nature differs or sources whose nature is identical but are then placed differently (essentially oriented differently). It will be shown that with a limited number of sources arranged in the area, it is possible to approach the expected directivity to a significant extent.

SUMMARY OF THE INVENTION

An object of the invention therefore is a method for the diffusion of a sound comprising the following steps:

- sound sources grouped together are positioned in an area located in a place where the sound is to be diffused,
- the sound sources are activated by electrical signals so that they produce said sound and diffuse it in this place,
- in order to diffuse this sound with an expected directivity outside this area, the functions of directivity of the sources are composed algebraically with coefficients to produce a composite function of directivity, and
- the electrical signals activating the different sources are modulated as a function of the values of these coefficients, wherein

- the directivity functions in modulus and in phase of the sources are established, a directivity function of a source being all the values of correspondence between an angle of a direction of propagation measured with respect to a reference and a value in modulus and phase of a sound signal emitted by this source and propagated in this direction,
- the coefficients of the algebraic composition are determined by an optimization in modulus and in phase, and
- the electrical signals activating the different sources are modulated in amplitude and in phase as a function of the values of these coefficients.

The optimization is done in minimizing the difference in modulus and in phase between the composite directivity and the expected directivity.

One method would consist, in a first stage, in carrying out the optimization on the modulus (gain of the filters) and, in a second stage, in determining the phase function of each of the filters to approach the desired directivity. In practice, the optimization of the modulus and of the phase are carried out in conjunction, as shall be seen in the rest of this description.

Indeed it has been realized, in the invention, that if the signals to be diffused were to be modulated in amplitude without attending to the phase, as in the document U.S. Pat. No. 5,233,664, the result an the expected directivity would not be ensured.

BRIEF DESCRIPTION OF THE DRAWINGS

The invention will be understood more clearly from the following description and from the appended figures. These figures are given purely by way of an indication and in no way restrict the scope of the invention. Of these figures.

MORE DETAILED DESCRIPTION

Figure 1B:
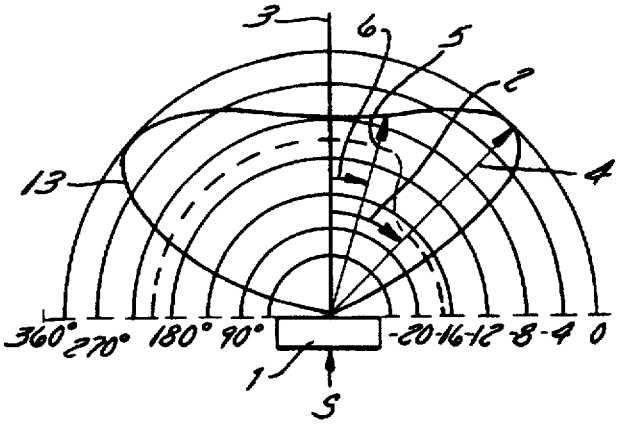
FIG. 1 shows a schematic view of the equipment used to implement the method of the invention.

FIG. 1 shows a device that can be used to implement the method of the invention. This figure shows a directivity pattern 13 of a source 1 which, in one example, may be a loudspeaker. This loudspeaker receives an electrical signal S that activates it. The function of directivity of the source 1 is constituted by all the values of correspondence between an angle, for example the angle 2 of a direction 4 of propagation, measured with respect to a reference 3 and a value in modulus and in phase of a sound signal emitted by this source 1 and propagated in this direction 4. For the direction 4 which corresponds to the angle 2, it has been indicated, for the directivity pattern shown, that the attenuation of the amplitude of the sound signal was 0 dB. For another direction 5 referenced by an angle G, the attenuation of the signal is, for example, −6 dB. To show the directivity patterns, the amplitude of the signal in one direction is compared with the amplitude of the signal in a nominal direction chosen arbitrarily or the direction in which it is the maximum. This is why the value is expressed in decibels. For the phase rotation, dashes are used to indicate the fact that the phase in the direction 4 has been shifted by 90° in relation to the phase in the direction 5.

If the source is linear, and in the invention it shall be assumed that the sources are linear, the directivity pattern is preserved irrespective of the level of signal s applied to the source 1. For the source 1, the sound propagated in the direction 4 will be always greater than the sound propagated in the direction 5 for one and the same activation signal. The phases will always be in correspondence.

Arbitrarily, the source 1 has been shown with a directivity pattern 13 that is greatly altered and different to a directivity pattern 14 of another source 7 to which the same signal 8 is applied. The invention will use sources whose values of directivity, assessed in a common reference system, are different from one another In fact, they will be values of absolute directivity, namely directivity of the source once it has been placed in the reproduction device and not intrinsic directivity (namely directivity assessed with respect to a reference linked to the source itself).

In the invention, there are sound sources 1, 7 and possibly other sources 8 available in an area 9. The area 9 herein is circumscribed by a surface 10 of the area. The area 9 is itself located in a place 11 in which it is sought, with the sources 1, 7 and 8, to diffuse the sound. The sources 1, 7 and a are activated by the electrical signal S.

To make a given directivity pattern for example that bearing the reference 12 in FIG. 1, the idea has emerged in the invention of superimposing the diffusion lobes 13 and 14 of the sources 1 and 7. The superimposition 12 of the lobes is the sum of the two functions of directivity 13 and 14, in modulus and in phase. The composite directivity function expected is in fact an algebraic composition and can be obtained by weighting the contributions of the sources by complex multiplier coefficients (modulus and phase). In correspondence, variable gain and variable phase amplifiers, 15 and 16 respectively, are therefore used to modulate the values of the signal S applied to the sources 1 and 7 or others. The amplifiers 15 and 16 are activated by control signals C prepared by a control unit 17 whose operation shall be seen further below.

If the gain of the amplifier 16 is reduced, there could be a smaller contribution of the lobe 14 of the source 7 to the directivity pattern obtained. The directivity pattern 18 shows that the contribution of the lobe 14 has been reduced as compared with its nominal shape. The depiction 19 of the reduction of the lobe 14 is of course artificial since, by assumption, the directivity pattern of the source 7 remains the same even when the level of application of the signal is lower. However, the depiction 19 shows the product of the gain of the amplifier 16 multiplied by the directivity pattern 14: this is the contribution.

It will nevertheless easily be understood, through FIG. 1, that with a sufficient number of sources it would be easy to make the most complex directivity patterns desired. The directivity patterns 12 or 18 may be made with sources such as the source 17 alone, but on condition that the main direction of propagation of the different sources 7 used are disoriented with respect to each other in the area 9. For example, it is possible to obtain a construction by fixing the loudspeakers to one another in such a way that their main directions or propagation (namely, for each loudspeaker, the perpendicular to the diaphragm at its center) are oriented by 30° on either side of the main direction of one of the sources.

Figure 1C:
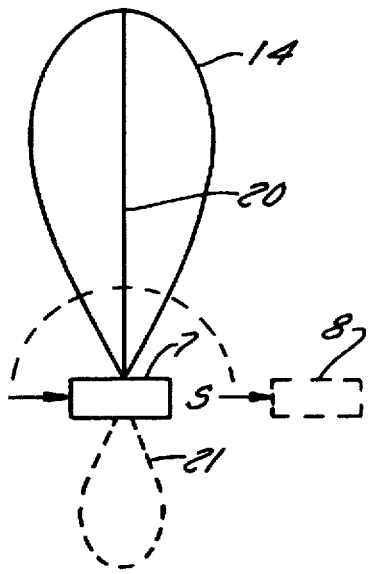
Figure 1D:
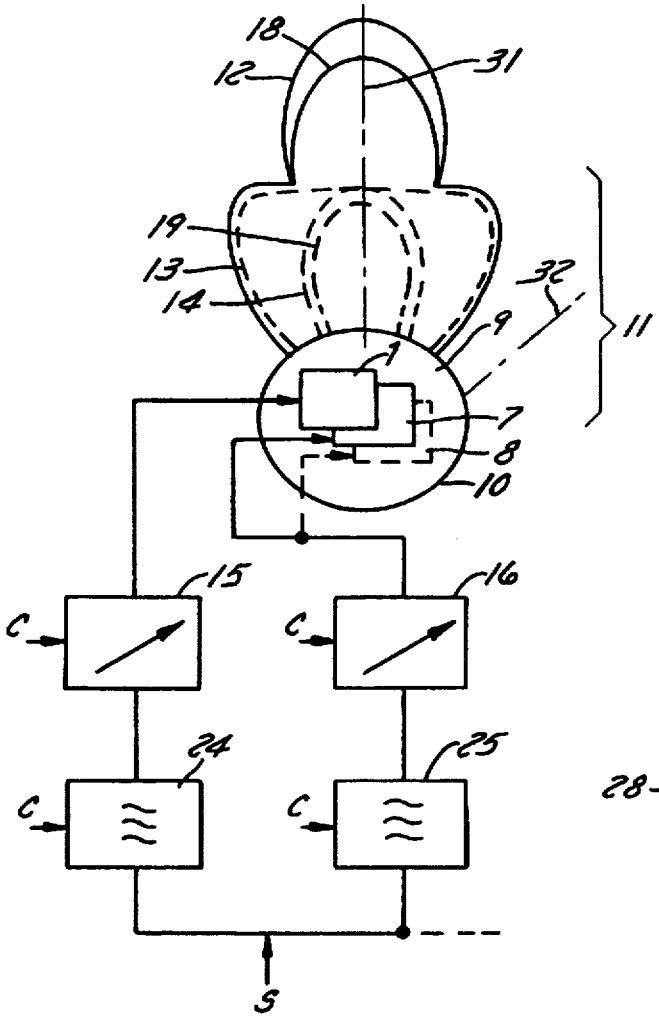
Figure 1A:
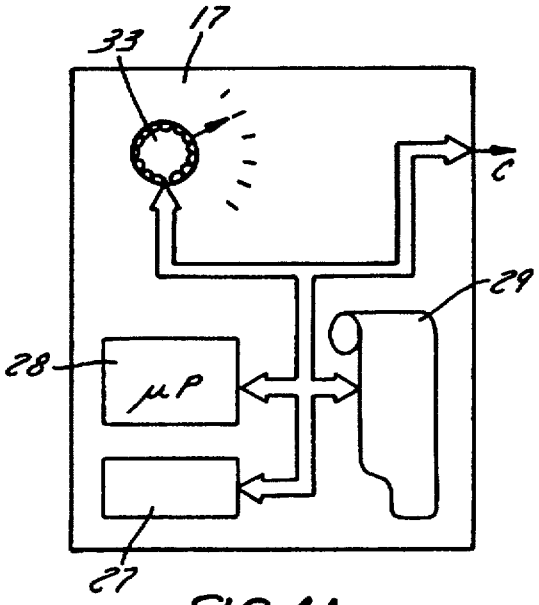
Figure 2:
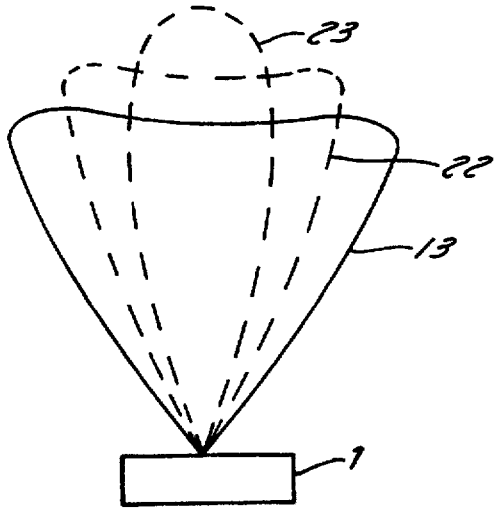
FIG. 2 gives a schematic view of the changes undergone by the directivity of the sources used as a function of the frequency.

Just as FIG. 1 shows the existence of a minor lobe 21 for the source 7, it is known, cf.Figure 2, that a source has a directivity pattern that changes as a function of the frequency. For example, but solely by way of an illustration, it may be considered that for the source 1, the directivity pattern 13 gets modified and takes the shape 22 and then the shape 23 when the frequency of the signal B rises. To take account of this effect, in the invention, fixed gain and fixed phase amplifiers are used, and the control of the gain and phase is transferred to frequency filters 24 and 25 respectively, making it possible to obtain the desired directivity pattern throughout the frequency spectrum. If the filters 24 and 25 are not present, the invention will work less well, for example in a narrower frequency band.

With the addition of the filters 24 and 25 (as many filters and as many amplifiers as there are sources to be controlled), it is possible, for each frequency range, or for each frequency, to set up the requisite directivity patterns. The way in which the algebraic composition is actually done shall be seen further below.

Figure 3:
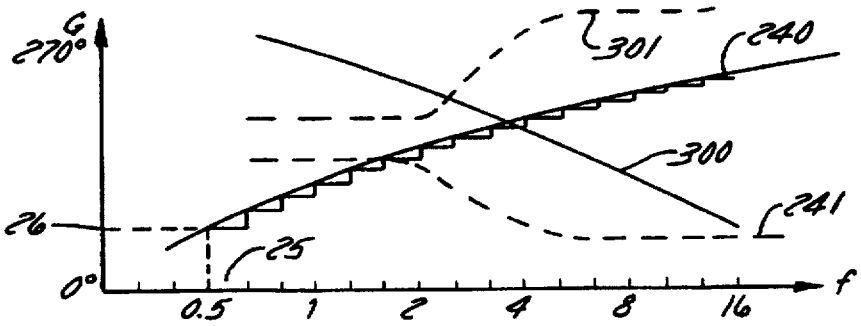
FIG. 3 gives a schematic view of the spectral graphs of frequency filters used in the invention.

FIG. 3 gives an example of a value of the gain G of the filter 24 and its associated amplifier 15, as a function of the frequency f expressed in kiloHertz. The curve 240 shows steps (but of course the reasoning is valid also for continuous frequency values) in which it is shown that, for each frequency range, for example the range 5, a useful level of gain is chosen, for example the level 26, to obtain a given directivity pattern by bringing about a contribution by a given source. In other words, for a given source, the curve 240 shows the progress of the contribution needed to obtain a given directivity pattern as a function of the frequency. FIG. 3 again, under the same conditions, uses dashes to show the phase diagram 241 of the filter 24 which is necessary in conjunction with the gain curve 240 to obtain said directivity pattern.

To put it concisely, in a memory 27 of the control unit 17, recordings are stored. These recordings comprise, for the curves 1240 and 241, a correspondence between the values of the ranges 25, the levels 26 of gain and the phase shifts. In the memory 27, as many lists of recordings such as those corresponding to the curves 240 and 241 are stored as there are sources 1, 7 or a to be controlled. To obtain the synthesis of the chosen directivity pattern, a processor 26 of the control unit 17 is made to process a processing program contained in a memory 29. In having its parameters set by the values contained in the memory 27, the processing program produces the commands C enabling the adjustment of the amplifiers 15, for optimization on a single frequency range, or the filters 24 for optimization performed on several frequencies or several frequency ranges. This type of operation is known. In one example, the filters 24 are switched capacitor filters having the specific feature of being easily parametrized in real time. It is also possible to use digital filtering techniques if the signal 9 is digital, in which case it may be converted into an analog signal before being applied to the sources.

FIG. 3 shows other curves 300 and 301 representing a type of filtering other than that of the filtering 240–241, to be applied for the same given source but corresponding to a different directivity pattern. For example, the curve 240 corresponds to the contribution of the source to the making of a directivity pattern of a trumpet while the curve 300 would correspond to the contribution of this same source to reproduce the directivity of a saxophone. Or again, the curve 240 corresponds to a directivity pattern of a trumpet emitting in a main direction 31 (FIG. 1) while the curve 300 would correspond to another main direction 32, disoriented with respect to the main direction 31. It can thus be seen that the use of the filters 24 and 25, associated with the amplifiers 15 and 16, enable the simulation of all possibilities; all the instruments radiating in any direction whatsoever or even any arbitrary function of directivity.

In a simple example shown in FIG. 1, the control unit 17 furthermore has a switch 33 enabling an operator to choose one directivity pattern rather than another. The switch will then indicate positions corresponding to different musical instruments such as the trombone, saxophone, piano, etc. Depending on the state of the switching, the microprocessor 28 will pick up the corresponding parameter-setting information S elements in the memory 27. Or else, according to what has been stated here above, the switch could have intermediate positions between two extreme positions called the left-hand and right-hand positions, characterizing a direction of propagation of a major lobe with respect to the area 9. In this case, it is possible to simulate the fact that a musician gradually turns from left to right before to his or her audience.

The switch 33 may, itself, be servocontrolled by external commands in order to modify the function of directivity obtained in the course of time.

Figure 4:
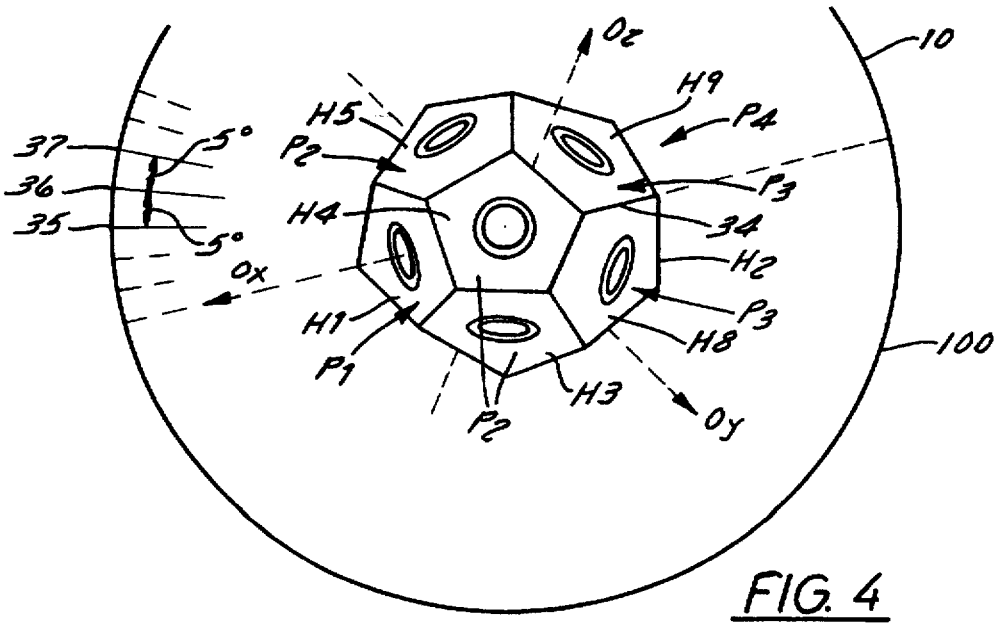
FIG. 4 shows a view in perspective of a real composite sound source used in the invention.

In the example shown in FIG. 4, the artificial sound sources used are loudspeakers mounted on the twelve faces of a dodecahedron inscribed within a sphere 34 having a radius of about 35 cm. Although the sources formed by the twelve loudspeakers H1 to H12 can be differentiated in terms of directivity owing to the fact that, already, they have quite different orientations, it has been chosen firstly to take identical loudspeakers and secondly to control certain of these twelve loudspeakers as a group. It has been decided to consider, as independent sources, sources P1 and P4 that are formed respectively by loudspeakers H1 and H2 mounted on two faces of the dodecahedron opposite to each other. A source P2 is then formed by five loudspeakers 13 to H7 (H6 and H7 not shown) mounted on the five faces contiguous to H1. Preferably, the loudspeakers are even electrically series-connected and not parallel-connected. A fourth source P3 is made by the association, also preferably in series, of the loudspeakers H8 to H12 (H10 to H12 not shown) mounted on the five faces contiguous to H2. This arrangement has the advantage of proposing an acoustical field with axial symmetry with an axis Ox going through the middle of HI and H2.

The area 9 considered at the beginning is herein constituted by this sphere 34. The surface 1o beyond which the directivity patterns obtained will be considered is a sphere having, in this example, a radius of 1.35 m about the center of the dodecahedric ball 34. Naturally, it is possible to have several balls such as 34 associated in one and the same field, the surface 10 being determined accordingly.

An explanation shall now be given, firstly of the way in which the directivity patterns of each of the sources (P1–P4) of the area 34 are determined and secondly of the way in which the previously cited algebraic combination is made in order to obtain an expected directivity pattern.

To determine the intrinsic directivity patterns of the sources, in this case P1 to P4, it is possible to model these sources. However, for reasons of simplicity, it has been chosen to measure their directivity by assessing what happens on the surface of the sphere 10. Given the axial symmetry cited herein with reference to the axis Ox, it will be enough to carry out this measurement on a circumference 100 of the sphere 10 and deduce the results of directivity in space by revolution about the axis Ox. At the time of the measurement, a sensitive microphone is shifted along the circumference 100 at successive places 35, 36 and 37 spaced out at 5° with respect to one another, while a signal is applied to only one of the sources P1 to P4 to be studied.

For reasons of simplicity, the signal 8 applied has been the pulse signal and the spectrum, amplitude and phase of the received signal have been measured at the positions 35 to 37. By standardizing the measurements made, frequency range by frequency range, with respect to a nominal value received at a position, it has been possible, for each source, to determine the curves 13 or 14 thus obtained as well as the associated phase curves. In practice, it is enough to perform this study for the sources P1 and P2. For the sources P3 and P4, 180° rotations about the axis Ox and about an axis perpendicular to ox give the measured patterns of spatial directivity. It could have been possible, if each loudspeaker H1–H12 had been individualized, to make the measurement for H1 alone and deduce the other patterns by rotations linked to the angles formed by the faces of the dodecahedron. These figures of directivity are memorized. For each source, frequency range by frequency range, the following are therefore stored in a memory: a correspondence between an acoustic level, an amplitude and a phase, and an angle of propagation. This correspondence may be analytical should the sources have been modeled.

The computation of the values of directivity has been done in one example with a frequency step of 23.4 Hz. This furthermore gives an idea of the width of the zones 25. It is even possible to make a finer appreciation if desired. It is possible on the contrary to be satisfied with an operation for rendering the frequency discrete by thirds of octaves.

A surface 10 has been chosen that is sufficiently great as compared with the area 34, for example in such a way that its diameter is four times the diameter of the area 34. It has been shown that since, in theory, it does not make use of remote field approximations, the choice of the surface 10, provided that this surface encompasses the sources, does not affect the validity of the approach and can therefore be arbitrary.

By way of an example, a method shall now be given that can be used to assess the algebraic composition, for a given frequency range, of the coefficients applied to the filters.

For a given frequency range having four sources, it is necessary to determine four complex coefficients, pertaining to attenuation and phase shift, of the signal B to be applied to the sources. In an initial stage, to simplify matters, we shall consider four directions for which the acoustic level to be obtained, given the directivity pattern to be achieved, must have the values A, B, C and D respectively. Each source P1 to P4 has, in these four directions, owing to its own directivity, factors of diffusion of the signal equal to P1*a*, P1*b*, P1*c*, P1*d*, . . . , P4*c*, P4*d*. These factors emerge from the directivity patterns measured beforehand. The coefficients to be applied to the amplifier filters 15, 16 and others are then values a, b, c, d such that:

a.P1*a*+b.P2*a*+c.P3*a*+d.P4*a*=A a.P1*b*+b.P2*b*+c.P3*b*+d.P4*b*=B a.P1*c*+b.P2*c*+c.P3*c*+d.P4*c*=C a.P1*d*+b.P2*d*+c.P3*d*+d.P4*d*=D

This system is a CRAMER system of four equations with four unknown quantities: a, b, c, d. The solution thereof can easily be found. It is enough then, with the control unit 17, to apply the corresponding commands to the amplifiers 15 and 16.

If the operation is stopped at this point, there will be obtained the effects of the invention limited to the frequency range studied. According to what has been referred to here above, it will be preferred to recompute the coefficients a to d for another frequency range (the lower third of an octave, the upper third of an octave, etc.). Continuing in this manner, the contributions, in frequency, of the different sources needed to achieve a given directivity pattern are determined so that they can be stored in a memory 27.

The simplified presentation with four main directions of assessment of the composite directivity may be extended to the entire space. However, given the limited number of sources, it cannot be claimed that identity will be met in this case. The operation will then consist of a minimization, in the sense of a standard, of the difference between the composite directivity obtained (for given values of the coefficients a, b, c, d) and the expected directivity. The techniques of mathematical regression, such as that of the least squares approximation, then give the best possible results for the values of the filters, in view is of the limited number of sources.

More specifically, the expected directivity is considered. This directivity is referenced $T(r,\omega)$ wherein r designates the position in space and $\omega$ the pulsation. Also considered are the functions of directivity $Pi(r, \omega)$ associated respectively with each source i constituting the restitution device. The filter associated with the source i is referenced $Ai(\omega)$. The optimization method consists in minimizing the functional:

$$P(\omega)=N[T(r,\omega m)-\Sigma Ai(\omega)Pi(r,\omega)]^2$$

where N designates a continuous or discrete norm bringing into play, if necessary, a weighting operation. For example, the error function could take the following form:

$$F(\omega)=\Sigma_k w_k|T(r_k, \omega)-\Sigma_i Ai(\omega)Pi(r_k, \omega)|^2$$

where the values of $r_k$ designate the different points of the space on which the optimization is carried out and the values of $w_k$ are weighting coefficients used to foster optimization on a region of space.

The trend with respect to analysis done up till now tends to ensure the reproduction of a field of pressure throughout space by the adjusting of moduli and phases. The filters 24 and 25 are therefore chosen accordingly, in amplitude and phase. The compromise as regards the modulus may be revised as a function of the phase constraints. A limited approach could consist in performing the optimization on the gain parameters alone.

For the diffusion, in the case of a use of media (disks, magnetic tapes, digital optical disks) where sounds are recorded, in addition to the signal S, the signals a, b, c, d (or their equivalents) for each frequency range are stored on these media or transmitted to the sources. In this case, the sources are provided with the control unit 17, and the memory 27 of this control unit could be eliminated and replaced by an input that provides for the permanent availability of the necessary coefficients of amplification and/or filtering. In the case of a radiofrequency diffusion, the signals a, b, a, d or their equivalents may also be broadcast.

What is claimed is:

1. A method of diffusing sound, the method comprising the steps of:

positioning sound sources in an area located in a place where said sound is to be diffused; and activating said sound sources with electrical signals to cause said sound sources to produce said sound and diffuse said sound in said place, including the steps of establishing a directivity function in modulus and in phase for each of said sound sources, said directivity function for a given sound source being all the values of correspondence between (1) an angle of a direction of propagation measured with respect to a reference of said place and (2) values in modulus and phase of a sound signal emitted by said given sound source and propagated in said direction, weighting each said directivity function in modulus and in phase by coefficients to produce a composite directivity function, optimizing said composite directivity function in modulus and in phase in order to fit a target directivity pattern, and modulating said electrical signals in amplitude and in phase as a function of the values of said coefficients.

2. A method according to claim 1, wherein said sound sources are identical and are arranged on the faces of a polyhedron.

3. A method according to claim 1, wherein said sound sources are identical and are arranged on the faces of a dodecahedron.

4. A method according to claim 3, wherein said sound sources are grouped in four groups, one first group comprising one source arranged on one first face of said dodecahedron, one second group comprising one second source arranged on one second face of said dodecahedron opposite to said first face, and one third group and one fourth group each comprising five sound sources arranged on the dodecahedron faces situated around said first and second faces, each individual group being activated by electrical signals devoted to said individual group.

5. A method according to claim 1, wherein said sound sources are arranged on the faces of a sphere.

6. A method according to claim 1 wherein, in order to perform said modulating step, a plurality of directivity functions proper to said sound sources are established during said establishing step, the directivity functions being established for a plurality of frequencies and being optimized to produce a plurality of composite directivity functions, and wherein the method further comprises the steps of computing differences between said plurality of composite directivity functions and a plurality of expected directivity functions, modifying the coefficients of the algebraic composition to minimize said differences, and filtering electrical signals applied to each source with filters whose transfer functions correspond to said modified coefficients.

7. A method according to claim 1, wherein said directivity function is established by modeling.

8. A method according to claim 1, wherein said directivity function is established by measuring, for each of said sound sources taken individually, at points of a surface surrounding said area, an acoustic pressure at either a given frequency or in a given frequency range.

9. A method according to claim 8, wherein frequency ranges corresponding to a third of an octave are utilized.

10. A method according to claim 1, further comprising the step of modifying the expected directivity by varying said values of said coefficients in the course of time.

11. A method according to claim 1, wherein said sound sources are constituted by groups of loudspeakers receiving a common input signal.

12. A method according to claim 1, further comprising the steps of transmitting said coefficients to a control unit of said sound sources at the same time as said electrical signals are transmitted to said sound sources, and altering the modulation of said electrical signals in real time as a function of said transmitted coefficients.

13. A method according to claim 1, further comprising the step of transmitting a signal to be diffused and information elements which adjust the directivity of said sound sources to said sound sources and to an associated control unit.

14. A method of diffusing sound, the method comprising the steps of:

positioning sound sources in an area located in a place where said sound is to be diffused, said sound sources having different absolute directivities and being spread over a three-dimensional surface; and activating said sound sources with electrical signals to cause said sound sources to produce said sound and diffuse said sound in said place, including the steps of establishing a directivity function in modulus and in phase for each of said sound sources, said directivity function for a given sound source being all the values of correspondence between (1) an angle of a direction of propagation measured with respect to a reference of said place and (2) values in modulus and phase of a sound signal emitted by said given sound source and propagated in said direction, weighting each said directivity function in modulus and in phase by coefficients to produce a composite directivity function, modulating said electrical signals in amplitude and in phase as a function of the values of said coefficients.

15. A method according to claim 14, wherein said sound sources are identical and are arranged on the faces of a polyhedron.

16. A method according to claim 14, wherein said sound sources are identical and are arranged on the faces of a dodecahedron.

17. A method according to claim 16, wherein said sound sources are grouped in four groups, one first group comprising one source arranged on one first face of said dodecahedron, one second group comprising one second source arranged on one face of said dodecahedron opposite to said first face, and one third group and one fourth group each comprising five sound sources arranged on the dodecahedron faces situated around said first and second faces, each individual group being activated by electrical signals devoted to the individual group.

18. A method according to claim 14, wherein said sound sources are arranged on the faces of a sphere.

19. A method according to claim 14 wherein, in order to perform said modulating step, a plurality of directivity functions proper to said sound sources are established during said establishing step, the directivity functions being established for a plurality of frequencies and being optimized to produce a plurality of composite directivity functions, and wherein the method further comprises the steps of computing differences between said plurality of composite directivity functions and a plurality of expected directivity functions, modifying the coefficients of the algebraic composition to minimize said differences, and filtering electrical signals applied to each source with filters whose transfer functions correspond to said modified coefficients.

20. A method according to claim 14, wherein said directivity function is established by modeling.

21. A method according to claim 14, wherein said directivity function is established by measuring, for each of said sound sources taken individually, at points of a surface surrounding said area, an acoustic pressure at either a given frequency or in a given frequency range.

22. A method according to claim 21, wherein frequency ranges corresponding to a third of an octave are utilized.

23. A method according to claim 14, further comprising the step of modifying the expected directivity by varying said values of said coefficients in the course of time.

24. A method according to claim 14, wherein said sound sources are constituted by groups of loudspeakers receiving a common input signal.

25. A method according to claim 14, further comprising the steps of transmitting said coefficients to a control unit of said sound sources at the same time as said electrical signals are transmitted to said sound sources, and altering the modulation of said electrical signals in real time as a function of said transmitted coefficients.

26. A method according to claim 14, further comprising the step of transmitting a signal to be diffused and information elements which adjust the directivity of said sound sources to said sound sources and to an associated control unit.

* * * * *

UNITED STATES PATENT AND TRADEMARK OFFICE

CERTIFICATE OF CORRECTION

PATENT NO. : 5,793,876

DATED : August 11, 1998

INVENTOR(S) : Derogis et al.

It is certified that error appears in the above-identified patent and that said Letters Patent is hereby corrected as shown below:

Column 2, lines 55 and 56, should be deleted and substituted with the following: Figure 1A shows a schematic view of the equipment used to implement the method of the invention; Figure 1B shows a directivity pattern corresponding to a sound source 1; Figures 1C and 1D show directivitypatternscorresponding to sound sources 7 and 8; --.

Column 2, line 66, delete "1" and insert --1A--.

Column 2, line 67, delete "This figure" and substitute –Figure 1B--.

Column 3, line 30, after "7" insert --, Figure 1C--.

Column 3, line 40, after "9" insert --, Figure 1D--.

Signed and Sealed this

Sixteenth Day of February, 1999

*Attest:*

*Attesting Officer*

*Acting Commissioner of Patents and Trademarks*